US005579750A

United States Patent [19]

Lease

[11] Patent Number: 5,579,750

[45] Date of Patent: Dec. 3, 1996

[54] PROJECTILE LAUNCHER FOR LAUNCHING AND ROTATING A DISK PROJECTILE

[75] Inventor: Thomas L. Lease, Westerville, Ohio

[73] Assignee: Dwight A. Marshall, Worthington, Ohio

[21] Appl. No.: 526,441

[22] Filed: Sep. 11, 1995

[51] Int. Cl.[6] ..... F41B 7/00; F41B 11/00; F41A 9/00

[52] U.S. Cl. ..... 124/20.1; 124/21; 124/25; 124/42; 124/81

[58] Field of Search ..... 124/42, 81, 20.1, 124/25, 21, 26

[56] References Cited

U.S. PATENT DOCUMENTS

| | | | |
|---|---|---|---|
| 186,334 | 1/1877 | Frost | 124/42 X |
| 498,070 | 5/1893 | Monaghan | 124/42 X |
| 539,183 | 5/1895 | Lewis | 124/42 X |
| 1,353,663 | 9/1920 | Napier | 124/21 X |
| 2,056,446 | 10/1936 | Dodge, Jr. | 124/14 |
| 2,484,844 | 10/1949 | Nicholas | 124/11 |
| 2,742,889 | 4/1956 | Clauss | 124/42 X |
| 2,755,788 | 7/1956 | Edwards | 124/42 X |
| 2,945,485 | 7/1960 | Skreberg | 124/42 X |
| 2,996,060 | 8/1961 | Appleby | 124/41 |
| 4,233,952 | 11/1980 | Perkins | 124/42 X |
| 4,347,828 | 9/1982 | Bridgeman | 124/81 X |
| 4,732,134 | 3/1988 | Waiser | 124/25 |
| 4,807,585 | 2/1989 | Gegere | 124/21 |
| 5,246,564 | 10/1993 | Peachey | 124/81 X |

*Primary Examiner*—Randolph A. Reese
*Assistant Examiner*—Thomas A. Beach
*Attorney, Agent, or Firm*—Dwight A. Marshall

[57] ABSTRACT

Apparatus for launching a disk-like projectile from a catapult with an aperture formed adjacent one end to receive structure of the catapult to configure the catapult to propel the apparatus forward. A channel in an opposite end is configured to receive the projectile with inner edges formed along internal sides and bottom thereof to engage the projectile. Structure of the apparatus offset from a central rotational axis of the received and engaged projectile holds the projectile in the apparatus during forward movement of the apparatus within the catapult and causes the projectile to rotate as the apparatus reaches the end of it's forward travel and releases the projectile.

12 Claims, 2 Drawing Sheets

PROJECTILE LAUNCHER FOR LAUNCHING AND ROTATING A DISK PROJECTILE

TECHNICAL FIELD

The invention relates to apparatus for launching a projectile from a catapult and in particular to a disc projectile launcher for use with catapults such as slingshots and cross bows.

BACKGROUND OF THE INVENTION

Catapult devices have been used since ancient times to generate external forces to launch and hurl missiles and projectiles which continue in flight by their own inertia. Typically, such devices have been in the form of scoop-like members, slings, slingshots, cross bows and the like. Slings for throwing a single projectile have been known since ancient times and are still currently in use. A scoop-like device in the form of a long curved wicker basket is used in the court game of Jai Alai to catch and throw a ball. A recent slingshot having a pair of opposite arms extended upward from a handle has elastic members affixed to each arm and to a pouch holding a plurality of pellets. Grasping the pouch to extend the elastic members and subsequently releasing the pouch enables a user of the slingshot to propel the accumulation of pellets toward a distant target.

Gun like devices have been designed to use rubber band controlled apparatus to select a spherical projectile from a magazine holding a number of spherical projectiles, place the selected projectile in a traveler and move the traveler from a cocked position to fire the projectile. Cross bow apparatus has been designed to fire a spherical projectile in addition to conventional bolts. Typically, such cross bow apparatus has a holder positioned on the stock of the cross bow and connected to the cross bow string. The holder is configured with a recess for holding the spherical projectile and functions to center and guide the spherical projectile during the firing operation.

Apparatus has also been devised for use in rotating and hurling disc-like projectiles. A hand held projector has a wire frame configured scoop like member and is intended to receive a disc projectile. As the projectile rolls down the wire frame scoop the projector is whipped around to propel the projectile toward the target. Gun configured slingshots have been devised to fire disc-like projectiles. Such types of apparatus have a barrel like configuration of a guide member with a bottom guide flange. An elastic band is fitted through a slot formed in the center of the guide flange and around the guide member to a tack positioned at the muzzle end of the guide member. A disc projectile is inserted within the muzzle end and positioned in a firing position at the rear of the guide member thereby stretching the elastic member. Upon release, the projectile is caused to rotate by the unequal contraction of the two sides of the elastic band and by engagement of edges of the disc projectile with the guide flange. Still other devices have been developed to fire disc projectiles. One such device is used with a rifle for launching disc-like projectiles such as grenades. In operation, the rifle fires a blank cartridge to operate a piston. Movement of the piston causes a piston rod to move pusher arms to propel a disc projectile along a pair of guideways so that serrations positioned on the projectile correspond with serrations in the guideway to cause the projectile to spin as it is launched.

A problem arises in that although sling types of catapults are known and take many form, few have been developed to launch disc projectiles and to rotate a disc projectile during the launch sequence. Although hand held scoop devices and gun type devices have been devised to rotate and launch disc projectiles, such devices require elaborate and expensive configurations that are not suitable for sling devices such as slingshots and cross bows.

Accordingly, a need exists for simple and inexpensive launch apparatus for use with slingshots and cross bows to hold and launch a disc projectile and to rotate the disc projectile at the end of the launch sequence.

SUMMARY OF THE INVENTION

The foregoing problem is solved by a member for use in holding and launching disc projectiles from slingshot and cross bow catapult apparatus. The member has a generally rectangular configuration formed to have an aperture adjacent one end for receiving an elastic band and string of slingshot and cross bow catapult structures so as to configure the catapult structures to launch and propel the disc projectiles. A channel is formed in another end of the member opposite the end adjacent the aperture and configured with inner edges formed along internal sides and bottom for receiving and engaging the disc projectile. Structure of the member is offset from a central rotational axis of the received and engaged projectile and holds the projectile during forward movement of the member and rotates the projectile when the member reaches the end of it's forward travel and releases the projectile.

In one embodiment of the invention the member is formed of a ductile material having the aperture formed adjacent the one end for receiving slingshot elastic band and cross bow string structures One side of the channel is formed to have a lesser width than the opposite side of the channel so as to be spreadable with respect to the opposite side to receive the projectile. The lesser width side is closable for holding the projectile within the channel with a center plane of the projectile perpendicular to the rotational axis of the projectile and lying along a central planer axis of the member. A structural member is positioned within the lesser width channel side to extend into the channel offset from the projectile central rotational axis and is openable with a spreading of the lesser width channel side for enabling the channel to receive the projectile. When the lesser width channel side is closed the structure engages and holds the received projectile during forward movement of the member and rotates the projectile as the member releases the projectile at the end of the launch sequence.

In another embodiment of the invention the member has a conduit formed in one side of the channel offset from the central rotational axis of the received projectile. A slidable member is located within the conduit at one end thereof to hold the projectile in the channel during forward movement of the member. At the end of the member forward movement, the slidable member moves within the conduit to the opposite end of the conduit to rotate the projectile as the member releases the projectile.

In yet another configuration of the invention the member has a cavity formed in one side of the member at an end opposite the aperture end with inner sides configured for receiving and engaging the projectile. A slot is formed at a first depth in an outer edge of the cavity to extend from a top surface of the one cavity outer edge toward a bottom surface of the cavity. Another slot is formed in another outer edge of the cavity opposite the one outer edge to extend from a top surface of the other cavity edge toward the bottom of the cavity at a second depth less than the first depth of the one slot. An elastic member is positioned within the slots to extend across a projectile located within the cavity such that the elastic member exerts a force on the projectile at a location offset from a central rotational axis of the received projectile. The elastic band positioned within the slots holds the projectile in the cavity during forward movement of the member and rotates the projectile as the member reaches the end of it's forward travel and releases the projectile. A plurality of ridges formed on outer surfaces of the member between the aperture and the member end enables a slingshot user to configure the slingshot to launch the projectile.

DETAILED DESCRIPTION

Figure 1:
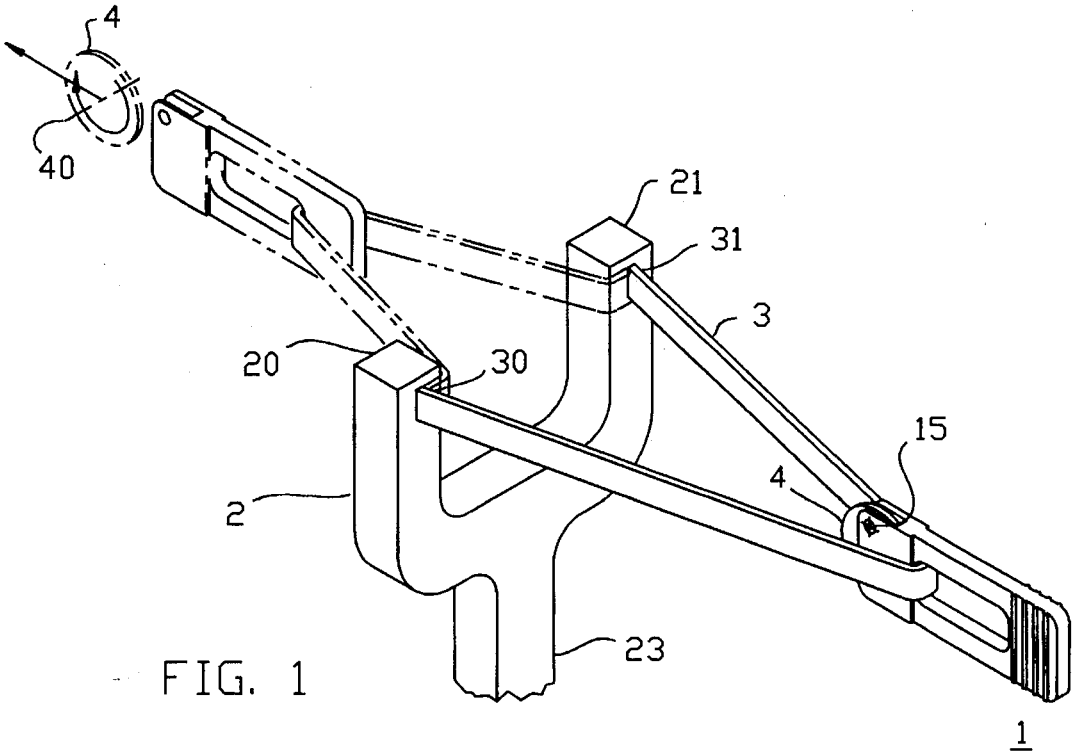
FIG. 1 illustrates a slingshot equipped with a disc projectile launcher embodying the principles of the invention.
Figure 2:
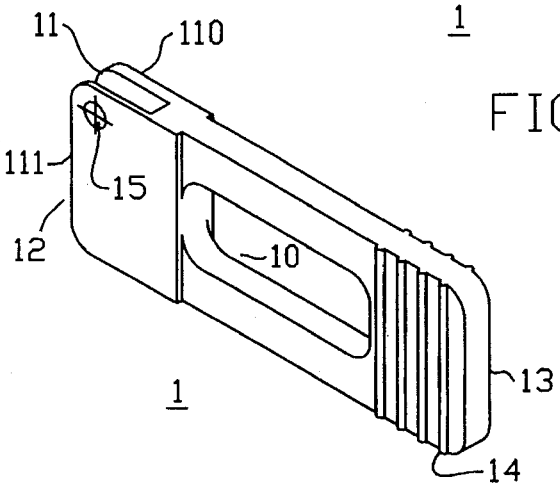
FIG. 2 illustrates an offset structure for holding a disc projectile in the projectile launcher of FIG. 1 and for rotating the disc projectile upon release of the projectile at the end of the forward movement of the projectile launcher.

In an exemplary of the invention, FIG. 1 of the drawing sets forth apparatus for launching a disc projectile from a catapult device such as slingshot 2. Typically, a slingshot such as slingshot 2 has a pair of opposite arms 20, 21 each extended upward from a stock or handle 23. A rubber sling or elastic member 3 has each end 30, 31 secured to a corresponding arm 20, 21 such that a user of the slingshot pulls elastic member 3 backward from arms 20, 21 and releases elastic member 3 to launch a projectile. The projectile launching apparatus, set forth in FIGS. 1 through 4 as member 1, may be, although not necessarily limited thereto, a generally rectangular configuration formed of a ductile material such as plastic or a hard rubber material. An aperture 10, FIG. 2, is formed adjacent one end 13 for receiving structure of the catapult such as elastic band 3, FIG. 1, to configure the catapult to propel projectile 4 forward. Ridges 14, FIG. 2, are formed on outer surfaces of member 1 between aperture 10 and end 13 to enable a user to grasp member 1 and stretch elastic band 3 to configure a catapult such as slingshot 2 into a launch projectile position.

Figure 3:
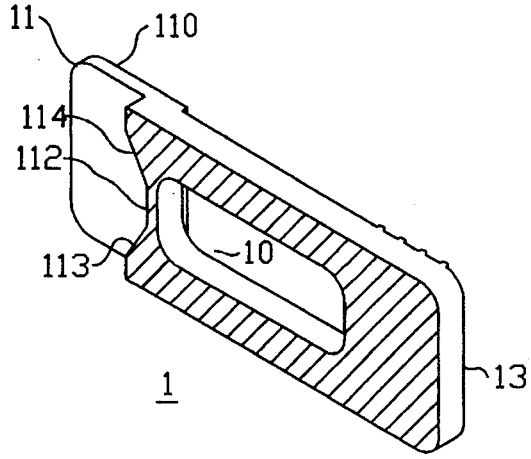
FIG. 3 illustrates a sectional view of the projectile launchers set forth in FIGS. 1 and 2 showing a channel for receiving and holding a disc projectile, FIG. 4 sets forth a top view of the projectile launchers of FIGS. 1, 2 and 3 showing disc holding and rotating structure projecting into a channel for engaging a disc projectile positioned within the projectile launcher.
Figure 4:
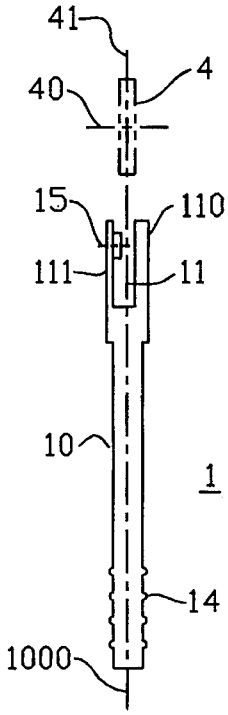

A channel 11 is formed in another end 12 opposite end 13 to hold a disc configured projectile 4, FIG. 1. One side 111 of channel 11, FIG. 4, as hereinafter described, is spreadable and formed for receiving projectile 4, FIG. 1. Inner edges 114, 112, 113, FIG. 3, are formed along internal sides and bottom of channel 11 and configured for engaging received projectile 4. Structure 15 FIGS. 2, 4 is positioned within channel side 111 and located offset from a central rotational axis 40, FIG. 1, of projectile 4 when projectile 4 has been received and engaged within channel 11. Projectile 4 is held in position within channel 11 by structure 15 during forward movement of member 1 during the launch sequence and rotated and released when member 1 reaches the end of it's forward travel.

In one embodiment of the invention, FIGS. 2, 4, one side 111 of channel 11 is formed to have a lesser breadth or width than an opposite side 110 so as to be spreadable with respect to opposite side 110 to receive projectile 4. When projectile 4 is positioned within channel 11, side 111 moves to a closed position to hold projectile 4 within member 1 with axis 41 of the center plane of projectile 4, FIG. 4, perpendicular to projectile rotational axis 40 and lying along central planer axis 1000 of member 1. Structure 15, which may be of a form of a device sometimes referred to as a header, is mounted in a hole located in channel side 111 to extend into channel 11 so as to be offset from projectile central rotational axis 40, FIG. 1, when projectile 4 has been received and positioned within channel 11 by the opening and spreading of channel side 111, FIG. 4. When channel side 111 has been closed after receiving projectile 4, structure 15 operates to engage and hold received projectile 4 in channel 11 during forward movement of member 1 and functions to rotate projectile 4 as it is released by member 1.

In operation, structure 15, FIG. 4, exerts a perpendicular force against a surface of projectile 4 to hold projectile 4 within channel 11. Structure 15 is configured such that this force in combination with the coefficient of friction of structure 15 on projectile 4 operates to rotate projectile 4 as member 1 reaches the end of the launch sequence and releases projectile 4. At the end of the forward travel of member 1, projectile 4 will have a linear momentum equal to the velocity of projectile 4 multiplied by the projectile mass. Structure 15 will create a drag force on projectile 4 at the point of contact of structure 15 with the surface of projectile 4. The length of the sliding contact on the surface of projectile 4 with structure 15 is divided by the release velocity of projectile 4 to determine the duration of the friction force. The normal force of structure 15 is multiplied by the coefficient of friction to determine the frictional force. Momentum of projectile 4 is reduced by the amount of the friction force multiplied by the duration of time that the force is applied by structure 15 to moving projectile 4. Structure 15 will cause a rotation of projectile 4 about rotational axis 40. The rotation or angular velocity of projectile 4 is equal to the friction force multiplied by the duration of contact of structure 15 with projectile 4 and the distance of the point of contact of structure 15 with the surface of projectile 4 from projectile rotational axis 40 divided by the mass moment of inertia of projectile 4.

In a typical example, although not limited thereto, a projectile 4 with a moment of inertia of 3 gram-cm$^2$ and 12,000 gram-cm per second momentum requires that structure 15 apply a drag force of 150 grams for approximately 210 microseconds to the offcenter position on the surface of projectile 4. This drag force applied to the surface of projectile 4 at a distance of 1.12 cm. offset from the rotational axis 40 will produce a rotation of approximately 2 revolutions per second. The linear momentum of projectile 4 will only decrease by approximately 30 gram-cm. per second which is about a 0.3% reduction in the projectile linear momentum.

Figure 5:
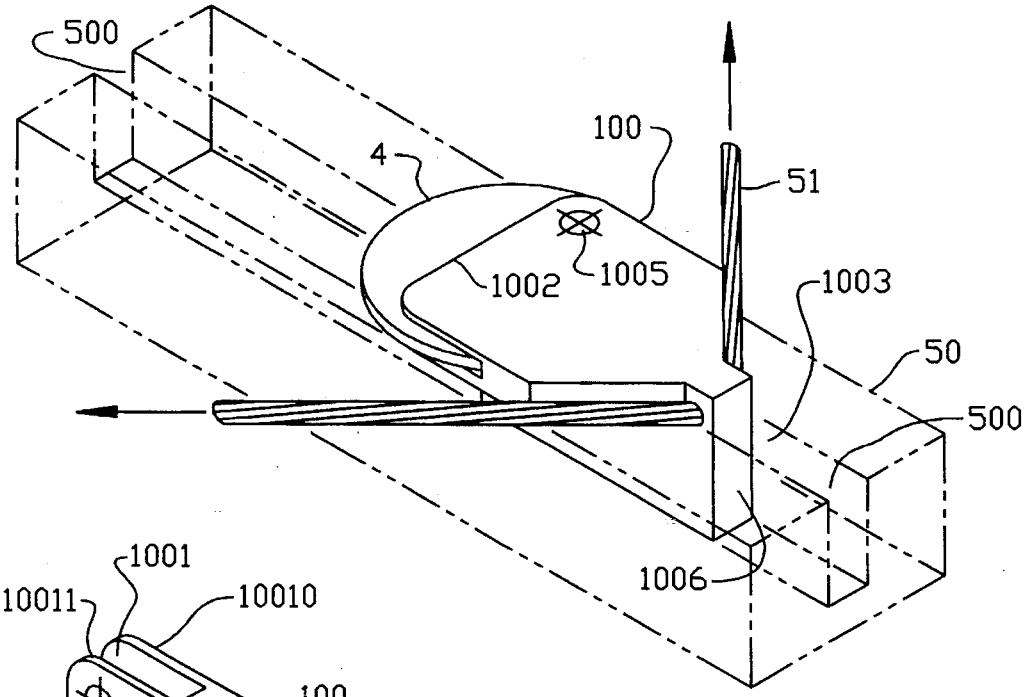
FIG. 5 illustrates a projectile launcher in accordance with principles of the invention for use with a cross bow to launch a horizontally positioned disc projectile.
Figure 6:
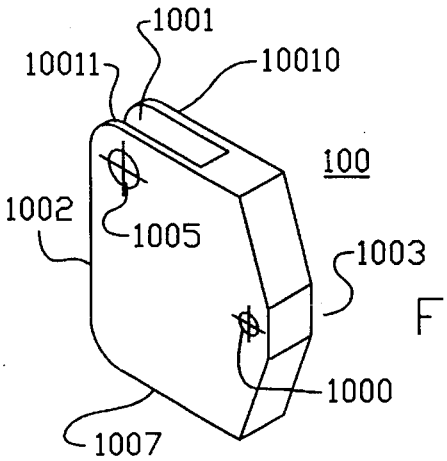
FIG. 6 illustrates a projectile launcher in accordance with principles of the invention for use with a cross bow to launch a vertically positioned disc projectile.
Figure 7:
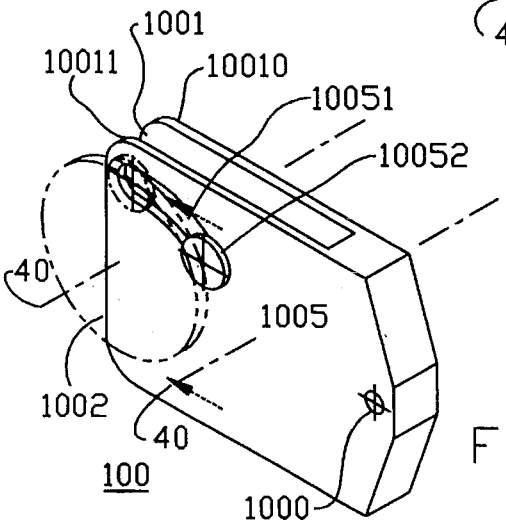
FIG. 7 illustrates another embodiment of a cross bow projectile launcher in accordance with the principles of the invention.

In another embodiment of the invention, FIGS. 5, 6 and 7, cross-bow apparatus may be used to launch disc projectile 4 in either a horizontal or vertical position. The cross bow, shown as required for the instant invention, has an elongated stock member 50 with a slot 500 formed along the center axis of a horizontal surface thereof to extend from one end of stock member 50 to the opposite end. A pair of bow arms, not shown, each formed of a resilient material that may be bowed from a released position and released from the bowed position to spring back to the released position, are located adjacent one end of stock member 50 and extend outward in the well known manner from opposite sides of stock member 50. The cross bow further has a string or sling member 51 with ends each secured to a corresponding end of each bow arm and is used in configuring the cross bow into a firing position by bending the bow arms into a bowed or firing position.

The horizontal disc projectile launcher, FIG. 5, for the cross bow is a member 100 formed of a plastic or similar type of material that may be configured to have a projection 1006 extending below the main body and formed to slideably mount member 100 in slot 500 of stock member 50. Although projection 1006 is shown as extended downward form the center of the bottom surface of member 100, it is to be understood that a pair of extension arms each extended along opposing outer edges of member 100 and extended downward therefrom to slide along side edges of stock member 50 could also be used to mount member 100 on the top surface of stock member 50 such that member 100 may move in a launch sequence along stock member 50 from a firing position to a launch position. Projectile launch member 100 has an aperture 1000, FIG. 6, formed adjacent one end 1003 for receiving sling member 51 to enable sling member 51 to bow the cross bow arms as member 100 is moved to the end of stock 50 to the projectile firing position. During the launch sequence, the release of string member 51 enables the cross bow arms to return to the released position thereby causing projectile member 100 to travel forward in stock member slot 500 from the firing position to the projectile release position. The vertical disc projectile launcher 100, FIG. 6, has side 1007 configured to slideably mount in slot 500 of stock 50, FIG. 5. Aperture 1000 is located as shown in FIG. 6 to receive sling member 51. With side 1007 placed in slot 500, projectile 4 is located in a vertical position for firing.

Member 100, FIGS. 5 and 6, has a channel 1001 formed in end 1002 opposite end 1003 with inner edges located along sides and a bottom thereof for receiving projectile 4. In one embodiment of cross bow projectile launch member 100, FIGS. 5 and 6, structure 1005 is mounted on a channel side 10011 and positioned offset from a central rotational axis of received projectile 4. Structure 1005 may be a header device formed of a material such as a hard rubber material and is positioned in a hole formed in channel side 10011. As earlier set forth for launch member 1, FIG. 4, structure 1005, FIGS. 5, 6, extends into channel 1001 to hold projectile 4 in channel 1001 during forward movement of member 100 in stock member slot 50 and generates a couple force rotating projectile 4 as member 100 reaches the end of it's forward launch sequence travel and releases projectile 4.

In another embodiment of the invention, FIG. 7, structure 1005 may have a conduit 10051 formed in straight and arc configurations positioned in channel side 10011 offset from the central rotational axis of a projectile 4 held in channel 1001. A slidable member 10052 is located within conduit 10051 and is configured to freely move from one end of conduit 10051 to the opposite end. The structure of slidable member 10052 may be a hard rubber pin positioned in conduit 10051 to extend into channel 1001 to engage a projectile 4 located in channel 1001 at a location offset from the center rotational axis 40 of projectile 4, FIG. 1. The pin may then have a pair of plate like members each affixed to the pin with each on a corresponding inner or outer surface of channel side 10011 to slidably hold the pin in conduit 10051. When projectile 4 is inserted into channel 1001, slidable member 10052 engages a side edge of projectile 4 and slides to the rear of conduit 10051. During the forward movement of member 100 in slot 500 in the launch sequence, slidable member 10052 is forced to remain in the rear of conduit 10051 and functions to hold projectile 4 in channel 1001. At the launch position, member 100 comes to an abrupt halt causing slidable member 10052 to move to the front of conduit 10051. The engagement of slidable member 10052 with projectile 4 and the movement of slideable member 10052 within conduit 10051 rotates projectile 4 when member 100 releases projectile 4.

Figure 8:
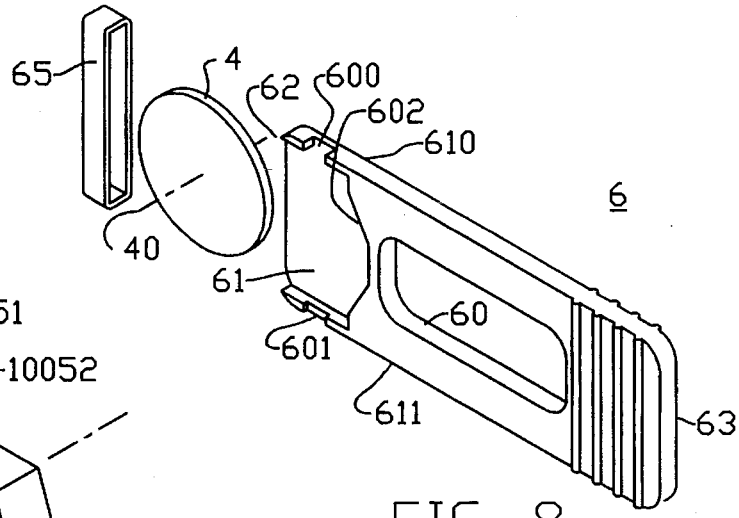
FIG. 8 illustrates another embodiment of the projectile launcher set forth in FIGS. 1 through 4.

In yet another embodiment of the invention, FIG. 8, a disc projectile launcher member 6 has an aperture 60 formed adjacent one end 63 for receiving elastic band 3, FIG. 1, of slingshot 2 to configure slingshot 2 to propel member 6 to a firing position to launch projectile 4. A cavity 61, FIG. 8, is formed in one side of the opposite end 62 for receiving projectile 4 with inner sides 602 configured for engaging a received projectile 4 inserted into cavity 61. A slot 600 is formed in one outer edge 610 of cavity 61 to extend from a top surface of the edge for a first depth toward a bottom surface of cavity 61. Another slot 60 1 is formed in another outer edge 611 of cavity 61 opposite the outer edge 610 and slot 600 to extend from a top surface of the other cavity edge toward the bottom of cavity 61 for a second depth less than the first depth of slot 600. An elastic member 65 is assembled within slots 600 and 601 to extend across the top of cavity 65 and across the back of member 6. Elastic band 61 expands to enable projectile 4 to be inserted into cavity 61 and positioned beneath elastic band 65. Since slot 600 is formed to have a depth greater than the opposite slot 601, the contraction of elastic band 65 exerts a force on projectile 4 positioned within cavity 61 at a location offset from a central rotational axis of projectile 4 to hold projectile 4 in cavity 61 during forward movement of member 6 and rotates projectile 4 as projectile 4 is released.

It is obvious from the foregoing that the facility, economy and efficiency of slingshot and cross bow apparatus may be substantially enhanced by simple and inexpensive launching apparatus of the instant invention having structure for holding and launching a disc projectile and for rotating the disc projectile at the end of the launch sequence.

I claim:

1. Apparatus for launching a projectile from a catapult wherein said apparatus comprises a member having an aperture formed adjacent one end for receiving structure of the catapult to configure the catapult to propel said member in forward travel and having a channel formed in another end opposite said one end wherein one side of said channel is openable and formed for receiving the projectile and wherein inner edges of said channel are formed along internal sides and a bottom surface of said channel for engaging the projectile and wherein said member has structure offset from a central rotational axis of the received and engaged projectile and operable upon closing of said one side for exerting perpendicular and drag forces on an outer surface of said projectile for holding the projectile during forward movement of said member and for rotating the projectile when said member reaches the end of forward travel and releases the projectile.

2. The projectile launching apparatus set forth in claim 1 wherein said member comprises a generally rectangular configuration formed of a ductile material having said aperture formed adjacent said one end for receiving the catapult structure and having said one channel side formed at a lesser width than an opposite channel side and spreadable with respect to said opposite channel side for receiving the projectile and closable for holding the projectile within said member with a planer center axis of the projectile perpendicular to the rotational axis of the projectile and lying along a central planer axis of said member.

3. The projectile launching apparatus set forth in claim 2 wherein said structure comprises a structural member positioned within said lesser width channel side to extend into said channel offset from the projectile central rotational axis and openable with a spreading of said lesser width channel side for enabling said channel to receive the projectile and operable upon a closing of said lesser width channel side for engaging and holding the received projectile during forward movement of said member and for rotating the projectile as said member releases the projectile.

4. The projectile launching apparatus set forth in claim 1 wherein said member comprises a generally rectangular configuration formed of a ductile material having said aperture formed adjacent said one end for receiving the catapult structure and having a conduit formed in an arc configuration positioned in said channel one side offset from the central rotational axis of the received projectile and having a slidable member located within said arc conduit at one end thereof during said member forward movement for holding the projectile in said channel and moveable within said arc conduit at the end of said member forward movement for rotating the projectile as said member releases the projectile.

5. Apparatus for launching a disk-like projectile from a catapult wherein said apparatus comprises a member having an aperture formed adjacent one end for receiving structure of the catapult to configure the catapult to propel said member forward and having a cavity formed in one side of another end opposite said one end for receiving the projectile and with inner sides of said channel configured for engaging the received projectile and having one slot formed at a first depth in an outer edge of said cavity extending from a top surface of said one cavity outer edge toward a bottom surface of said cavity and having another slot formed in another outer edge of said cavity opposite said one outer edge extending from a top surface of said other cavity edge toward the bottom of said cavity at a depth less than said one slot depth and having an elastic member positioned within said slots to extend across a projectile located within said cavity such that said elastic member exerts a force on the projectile at a location offset from a central rotational axis of the received projectile for holding the projectile in said cavity during forward movement of said member and for rotating the projectile as said member reaches the end of forward travel and releases the projectile.

6. The projectile launching apparatus set forth in claim 5 wherein said member comprises a plurality of ridges formed on outer surfaces of said member between said aperture and said one end to enable a catapult user to configure the catapult to launch the projectile.

7. Apparatus for use with a sling-shot catapult having a pair of opposite arms extended from a handle and an elastic member with ends secured to each of the arms in launching a disk projectile wherein said apparatus comprises a generally rectangular member formed of a ductile material having an aperture formed adjacent one end for receiving the elastic member and enable the elastic member to be stretched outward from said arms and released to propel said member forward and having a channel formed in another end opposite said one end with one side of said channel formed of a lesser width than an opposite side of said channel for receiving the disk projectile and with inner edges of said channel configured for engaging the received disk projectile and wherein said member has a structure member positioned within said channel lesser width side offset from a central rotational axis of the received projectile for exerting a perpendicular force on an outer surface of the disk projectile to hold the disk projectile during the forward travel thereof and for generating a couple force on the disk projectile outer surface thereby rotating the projectile as said member reaches the end of forward travel and releases the projectile.

8. Apparatus for use with a cross-bow catapult having a pair of arms each extended outward from opposite sides of a stock member and a sling member with ends secured to each of the arms for launching a disk-like projectile wherein said apparatus comprises a member formed of a ductile material configured to mount in a slot of the stock member and having an aperture formed adjacent one end for receiving the sling member and enabling the sling member to bow ends of the arms to enable said member to travel forward on the stock member upon release of the sling member and with said member having a channel formed in another end opposite said one end with inner edges of said channel formed along sides and a bottom surface thereof for receiving the projectile and having structure positioned on one side of said channel and offset from a central rotational axis of the received projectile for holding the projectile during forward movement of said member on the stock member and for generating a couple force rotating the projectile as said member reaches the end of forward travel on the stock member and releases the projectile.

9. Apparatus for use with a sling-shot catapult having a pair of opposite arms extended from a handle and an elastic member with ends secured to each of the arms for launching a disk-like projectile wherein said apparatus comprises a generally rectangular configured member formed of a ductile material having an aperture formed adjacent one end for receiving the elastic member and enabling the elastic member to be stretched outward from the arms and released to propel said member forward and having a cavity formed in one side of another end opposite said one end configured for receiving the projectile and having one slot formed at a first depth in an outer edge of said cavity extending from a top surface toward a bottom surface of said cavity and having another slot formed in another outer edge of said cavity opposite said one outer edge extending from a top surface of said other cavity edge toward the bottom surface of said cavity at a depth less than said one slot depth and having an elastic band member positioned within said slots to extend across a back of said member and across a projectile located within said cavity for exerting a force on the received projectile at a location offset from a central rotational axis of the received projectile to hold the projectile in said cavity during forward movement of said member and for rotating the projectile as said member reaches the end of forward travel and releases the projectile.

10. Apparatus for launching a projectile comprising a generally rectangular member formed of a plastic material having an aperture formed adjacent one end for receiving structure of a catapult for configuring the catapult to propel said member in forward travel and having a channel formed in another end opposite said one end with one side of said channel spreadable and with internal sides of said channel formed for receiving the projectile and wherein said member has means mounted in said channel offset from a central rotational axis of the received projectile for exerting a perpendicular force on an outer surface of the projectile to engage and hold the projectile during forward travel of said member and a drag force on said projectile outer surface for rotating the projectile as said member reaches the end of forward travel and releases the projectile.

11. Sling-shot apparatus for launching a disk-like projectile comprising a pair of opposite arms extended from a handle, an elastic member with ends secured to each of said arms, and a generally rectangular member formed of a plastic material having an aperture formed adjacent one end for receiving said elastic member and enabling said elastic member to be stretched outward from said arms and released to propel said member forward and having a channel formed in another end opposite said one end with one side of said channel of a lesser thickness than an opposite side and spreadable with respect to said opposite side for receiving the projectile and structure mounted on said channel one side offset from a central rotational axis of the received projectile to project into said channel for engaging and holding the projectile during forward movement of said member and for rotating the projectile as said member reaches the end of forward travel and releases the projectile.

12. Cross-bow apparatus for launching a disk-like projectile comprising a stock member having a slot formed in one edge surface thereof, a pair of bow arms each formed of an elastic material that may be bowed and which extend outward from opposite sides of one end of said stock member, a sling member with ends secured to corresponding ends of each bow arm, and a member formed of a ductile plastic material configured to mount in said stock member slot and having an aperture formed adjacent one end for receiving said sling member and for enabling said sling member to bow ends of said arms to enable said member to travel forward in the stock member slot upon release of said sling member and with said member having a channel formed in another end opposite said one end with inner edges formed along sides and a bottom surface thereof for receiving the projectile and structure positioned on one side of said channel and offset from a central rotational axis of the received projectile for holding the projectile during forward movement of said member in the stock member slot and for generating a couple force rotating the projectile as said member reaches the end of forward travel in said stock member slot and releases the projectile.

* * * * *